United States Patent [19]

Seegmiller

[11] Patent Number: 4,666,344

[45] Date of Patent: May 19, 1987

[54] TRUSS SYSTEMS AND COMPONENTS THEREOF

[76] Inventor: Ben L. Seegmiller, 3500 Loren Von Dr., Salt Lake City, Utah 84124

[21] Appl. No.: 809,139

[22] Filed: Dec. 16, 1985

[51] Int. Cl.[4] ..... E21D 20/00; E21D 21/00

[52] U.S. Cl. ..... 405/259; 405/288

[58] Field of Search ..... 405/148, 258–261, 405/288, 290; 299/11; 52/225, 226

[56] References Cited

U.S. PATENT DOCUMENTS

| | | | |
|---|---|---|---|
| 1,686,910 | 10/1928 | Frease | 52/226 |
| 3,427,811 | 2/1969 | White | 405/259 |
| 3,505,824 | 4/1970 | White | 405/259 |
| 4,349,300 | 9/1982 | Kelley | 405/259 X |
| 4,395,161 | 7/1983 | Wilson et al. | 405/259 |
| 4,498,816 | 2/1985 | Korpela et al. | 405/259 |

*Primary Examiner*—Cornelius J. Husar
*Assistant Examiner*—Nancy J. Stodola
*Attorney, Agent, or Firm*—M. Ralph Shaffer

[57] ABSTRACT

Truss systems and components thereof for use in connection with supporting rock formations in underground mines, caverns, storage vaults, and so forth. Multiple types of truss brackets of unique design are incorporated in the various systems which also include tensioning tie rods and anchor bolts. The truss bracket components are designed so that a minimum or no force couples are exhibited when the tie rod means employed are tightened down in their interconnection between associated truss brackets. Various truss systems accommodate mine entries, two-way, three-way, and four-way passageway configurements, and so forth. Additionally, provision is made for intercoupling trusses together.

17 Claims, 16 Drawing Figures

TRUSS SYSTEMS AND COMPONENTS THEREOF

FIELD OF INVENTION

The present invention relates to truss systems and components thereof for supporting and retaining rock formations as are found in hardrock mines, trona mines, coal mines, underground caverns, storage vaults, passageways, and so forth. The truss components, generally in the form of truss brackets, are uniquely designed so as to maximize stability and integrity of the components and their systems, when such systems are placed in tension. Suitable rock formation anchor bolts and locking nuts therefor are provided so as to secure directly and rigidly against the exposed surfaces of applicable rock formations the bearing plate surfaces of related truss brackets.

DESCRIPTION OF PRIOR ART

Certain prior art is currently known in connection with truss systems for mines, for example. Such prior art consists of the following:

U.S. PATENTS

U.S. Pat. No. 3,427,811
U.S. Pat. No. 3,505,824
U.S. Pat. No. 4,349,300
U.S. Pat. No. 4,395,161
U.S. Pat. No. 4,498,816

BRITISH PATENT

British Pat. No. 899,119

BUREAU OF MINES PUBLICATION

"Evaluation of Roof Trusses, Phase I", prepared for United States Department of Interior, Bureau of Mines, by Department of Civil Engineering, University of Pittsburg, Summary Report on U.S.D.M. Grant No. G0166088, Feb. 28, 1979.

Each of the above patents and the publication listed relate to the present invention in the provision of roof trusses in general and the manner of their securement to rock formations; none of the above cited art, however, teach the unique concepts and structures as provided in the various truss bracket components of the several systems about to be described nor the manner by which trusses made up of the same, with associated tie rods, can be employed in multiple truss inter-lock systems. Additionally, none of the above cited art, taken singly or in combination, teach the virtual elimination of force couples which might otherwise act upon otherwise-designed truss brackets so as to cause their failure during the tensioning process by the associated tie rods, or subsequently.

BRIEF DESCRIPTION OF INVENTION

At the outset it is to be observed that the truss brackets, bracket combinations, and truss structures hereinbelow described in detail, can be employed to support rock formations as in hardrock mines, trona mines, coal mines, and at such uses thereof can be extended to include supporting of mine roofs, ribs, floors, underground caves, tunnels, storage vaults, toxic waste repositories, underground power stations and caverns, and any other usage wherein earth or other formations are to be supported. The present invention finds particular usage in connection with the supporting of mine roofs, however.

Principal bracket members of the truss systems hereinbelow described include uniquely designed end brackets, connector brackets, and support brackets. The various truss systems, while necessarily including end brackets as, for example, are useful in anchoring truss systems by suitable anchor bolts over and interior of mine ribs, yet the intermediate connector brackets and/or support brackets may or may not be used, depending upon the particular truss structure or structures to be desired. The trussing systems can accommodate mine entries, two-way, three-way, and four-way passage configurements, and so forth. Inter-bracket connection is made possible through the use of tensioning tie rods which interconnect the various brackets. The brackets themselves also include provision for anchoring the same by suitable anchor bolts or rock bolts to the actual rock formation, for example, being trussed. The support brackets themselves can be designed for three-way and four-way tie rod tensioning means, this depending upon particular trussing configurements to be desired. In fact, even more than four-way configurements can be used, this depending upon the polygonal nature of the depending flange portion or portions supplied the support bracket. Intermediate connector brackets can be used herein not only as a juncture for tie rod continuations, but also as a separate anchoring means relative to the rock formation being buttressed by the truss system. All of the truss brackets herein include a supporting bearing plate and also depending flanges configured so as to accommodate mutual ties therebetween by tensioning tie rods, and also to provide a suitable anchoring of the bearing plates of the various truss brackets to the rock formation being worked. Particular use is had in connection with the plural-way support bracket contemplated herein wherein cross-trussing in various truss systems can be accommodated whereby trusses can be coupled together at, for example, a central point.

OBJECTS

Accordingly, a principal object of the present invention is to provide new and improved truss brackets.

A further object is to provide new and improved trusses and truss systems.

An additional object is to provide a modular truss system to accommodate a variety of passageway or opening configurements.

A further object is to provide trussing components wherein force couples can be minimized, thereby deterring bracket failure during and after the tensioning process and also precluding the necessity of use of bulky bracket components.

BRIEF DESCRIPTION OF THE DRAWINGS

The present invention may best be understood by reference to the following description, taken in connection with the accompanying drawings in which:

For convenience of illustration

FIG. 7 is a top view of a four-way passageway structure wherein truss structure in the form of a cross is used herein, the muliple-way central bracket accommodating interconnection at a central support point.

FIG. 8 is similar to FIG. 7 but illustrates the intermediate connector brackets as being removed, this being suitable for passageway widths which are somewhat restricted.

FIG. 9 is a top plan similar to the structure of FIG. 7 but illustrating the central, muliple-way truss bracket as having, as its polygonal shape, a generally triangularly-shaped flange to accommodate three-way connection of tie rod means leading to intermediate truss connector brackets.

FIG. 10 is similar to FIG. 9 but illustrates direct connection of the central truss support bracket to the truss end brackets anchored to the various portions shown of the rock formation accommodated.

FIG. 13 is a top plan of alternate truss structure wherein the central tie rods used are simply crossed.

FIG. 14 illustrates the trussing of an entry, for example, by plural trusses of the type described herein.

FIG. 15 is similar to FIG. 14 but illustrates plural, parallel mutually-spaced trusses as being employed without the usual truss connector brackets and truss support brackets.

FIG. 16 is a top plan in diagramatic form of an interlocked trussing system incorporating plural parallel trusses and cross trussing structures wherein the truss support brackets that are centrally disposed are interconnected together by suitable tensioning tie rods means.

DETAILED DESCRIPTION OF PREFERRED EMBODIMENTS

Figure 1:
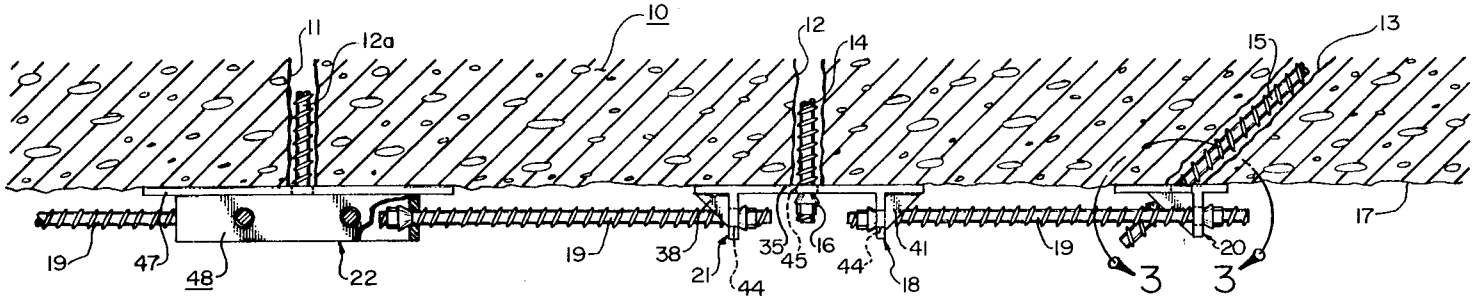
FIG. 1 is a side view and partially sectioned and shown in fragmentary form, of a representative truss structure half including one of the two end brackets employed, one intermediate connector bracket, and a central, plural-way support bracket; it will be understood that, disposed to the left of the left-located support bracket, there will be included a similar connector bracket followed by an end bracket, this to complete the multiple bracket tie-rod structure.

In FIG. 1 rock formation 10 is seen to include plural bore holes or apertures 11, 12, and 12*a* that individually receive a series of rock bolts 13, 14 and 15. These rock bolts will be secured in place by the conventional resin anchor used in connection with rock bolts in general, by cementitious matter, or by other means. The individual rock bolts are preferably threaded and include locking nuts 16 threaded thereon. Secured to and between such rock bolts for supporting surface 17 of rock formation 10 is a truss structure 18, the same incorporating a series of tie rods 19 and truss brackets 20, 21, and 22. For convenience of nomenclature, truss bracket 20 will be referred to hereinafter as an "end bracket", this for convenience; correspondingly, truss bracket 21 will be referred to as a "connector bracket"; and truss bracket 22 will be termed a "plural-way support bracket". The details of end bracket 20 are best seen in FIGS. 3 through 6 which will now be considered.

Figure 4:
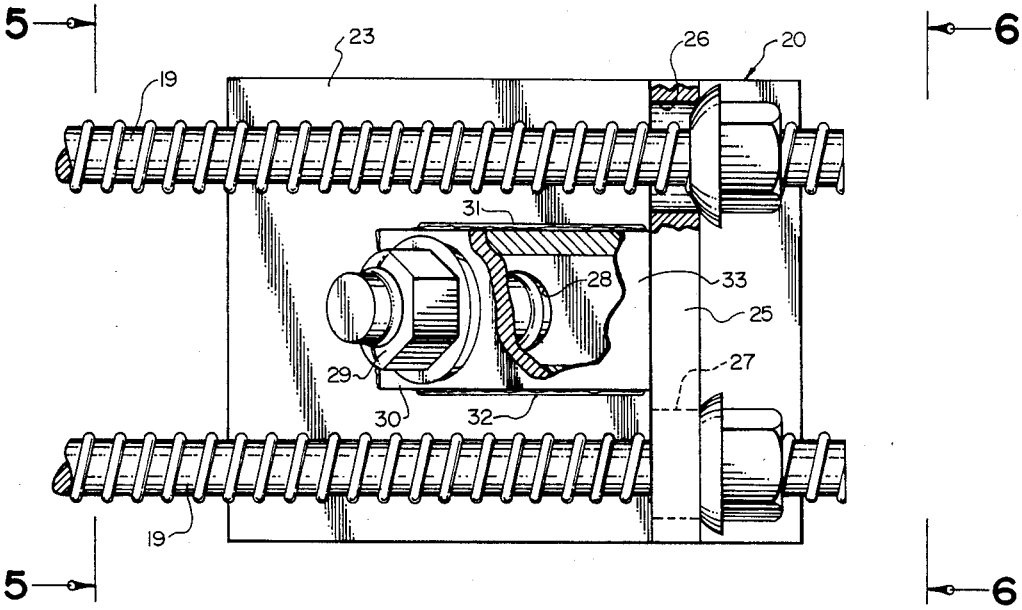
FIG. 4 is a bottom plan of the structure of FIG. 3.
Figure 5:
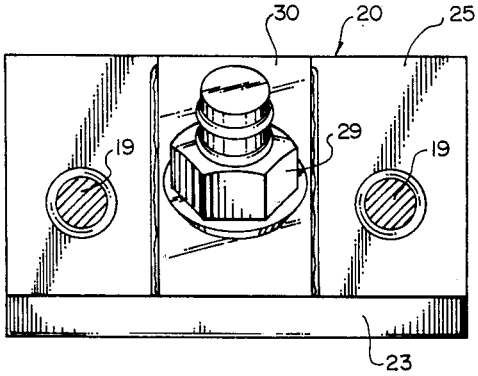
FIG. 5 is an intermediate end view of the structure of FIG. 4 and is taken along the line 5—5 in FIG. 4.
Figure 6:
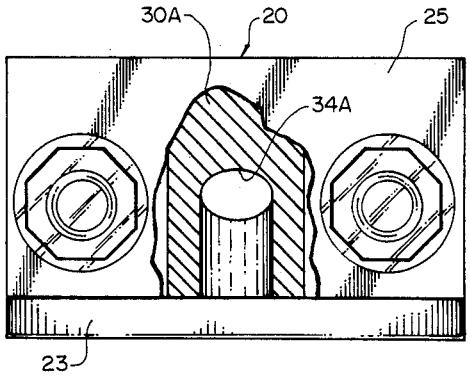
FIG. 6 is an outermost end view of the truss end bracket shown in FIG. 4 and is taken along the line 6—6 in FIG. 4; for convenience of illustration the structure in FIG. 6 is partially broken away and sectioned.

End bracket 20 includes a bearing plate 23 having upper supporting surface 24. Depending from and integral with bearing plate 23 is a depending flange 25, the latter having a pair of tie rod admittance apertures 26 and 27. In a preferred form of the invention, the depending flange 25 will be separate from but will be welded to the undersurface of bearing plate 23. Bearing plate 23 also includes an aperture 28 for receiving anchor bolt 15, the latter being provided with securement nut 29. Gusset portion 30 is welded to the inner surfaces of bearing plate 23 and depending flange 25. This gusset portion may be solid, as seen at 30A in FIG. 6, or may be comprised of a pair of gusset members 31 and 32 which are welded to bearing plate 23 and depending flange 25, and also welded and thus joined to an overlapping strap or plate 33 as seen in FIG. 4. In any event, the outer appearance and general function of gusset portion 30 will be the same as generally indicated in FIG. 5. Aperture 34 will be supplied in plate 33 to accommodate anchor bolt 13 and aperture 34A will be provided in the solid gusset portion of FIG. 6 where this embodiment is employed. Suitable spec welding will be used to achieve the greatest strength as to the joining of depending flange 25 to bearing plate 23 and also the individual or several elements of gusset portion 30 relative to the bearing plate and depending flange. While it is possible that end bracket 20 can be cast, much greater strength and less bulkiness can be achieved where the end bracket 20 is fabricated by separate parts in the manner hereinabove described, to be welded together.

Returning now to FIGS. 1 and 2 it is seen that connector bracket 21 includes a bearing plate 35 and a pair of depending flanges 36 and 37 welded thereto. Likewise provided are a series of gussets 38–43 that are welded in place in the manner indicated in FIG. 2. A series of apertures 44 will be supplied in the two depending flanges 36 and 37 to accommcdate the ends of tie rods 19. Likewise, aperture 45 will be supplied in the bearing plate to accommodate upwardly oriented rock bolt 14 as secured to the bearing plate by locking nut 16. The ends of all of the tie rods will be provided with similarly or identically configured locking nuts 46.

Figure 2:
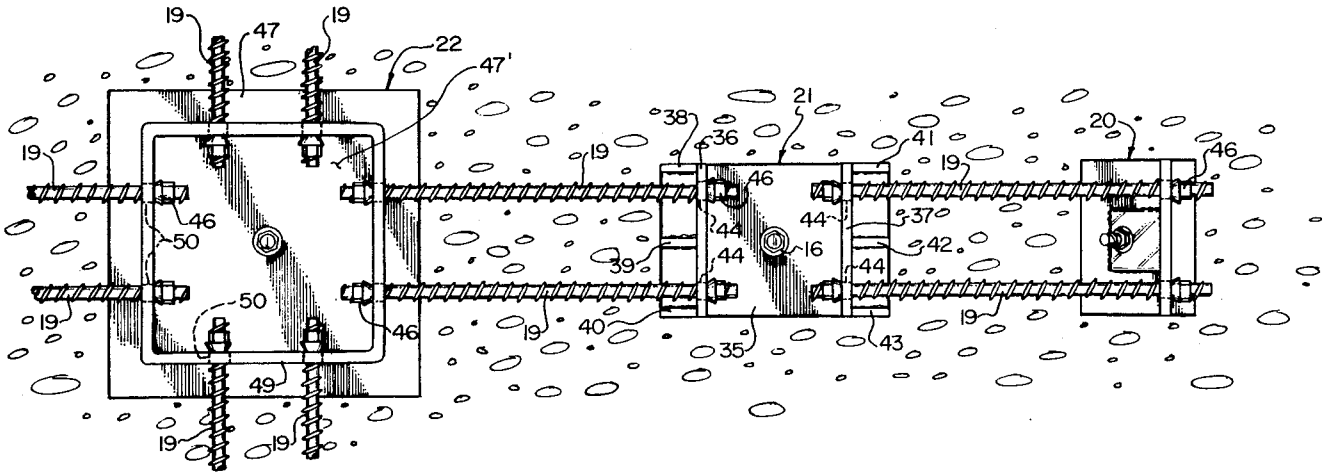
FIG. 2 is a bottom plan of the structure shown in FIG. 1.
Figure 3:
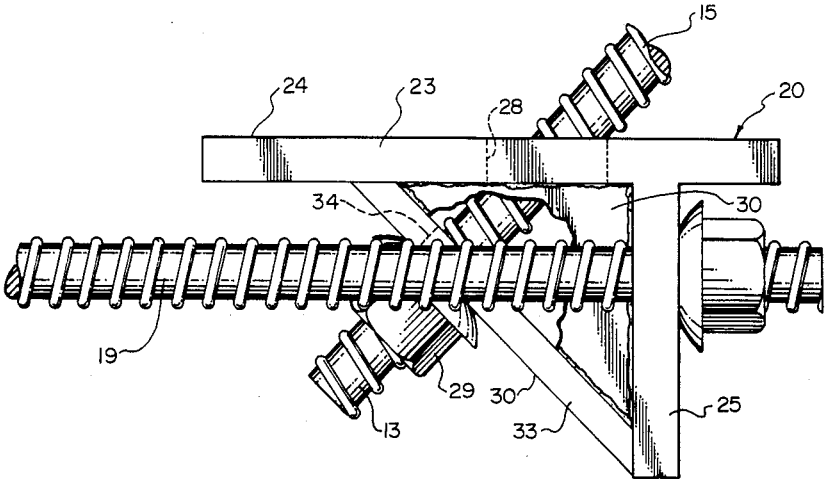
FIG. 3 is a fragmentary detail taken along the arcuate line 3—3 in FIG. 1 illustrating the configurement of the truss end bracket use herein.

In turning now to the left-hand portions of FIGS. 1 and 2, it is seen that the remaining truss bracket, namely, plural-way support bracket 22 includes a bearing plate 47 and, welded to the undersurface thereof, depending polygonal flange 48 formed of several joined-together flange portions 39. While the several flange portions may be separate and gusseted, it is highly preferred that a unitary structure be used in connection with flange 48, this to supply maximum strength or holding power for the structure. Flange 48 will be welded at its interior and/or exterior sides to the underside 47′ of bearing plate 47. A series of apertures 50 will be supplied in the several flange portions 49 to accommodate the various tie rods 19, the ends of the same being routed therethrough and secured by nuts 46, by way of example.

Figure 7:
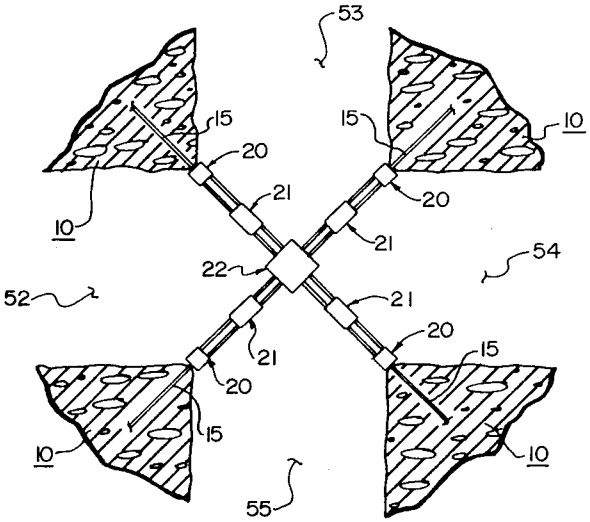

Broadly, the truss structures of FIGS. 1 and 2 are shown in fragmentary view and include, to the left of the plural-way support bracket 22 an additional connector bracket 21 and end bracket 20 so that the structure, when in its complete form, will assume the appearance of four-way truss structure 51 in FIG. 7 when the same is employed as a four-way truss structure relating to the four passageways 52,53, 54, and 55 that join together as seen in FIG. 7. Thus, the structure is not only elongate in one longitudinal direction, but additionally represents a cross-type structure having a second lateral direction. The various truss brackets 20, 21, and 22 are identified in FIG. 7, with the various tie rods connecting the truss together, the four ends of the truss may be secured by the four anchor bolts or rock bolts 15.

Figure 11:
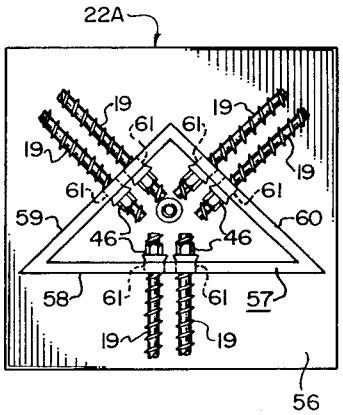
FIG. 11 is a bottom plan of the truss support bracket of FIGS. 9 and 10.
Figure 12:
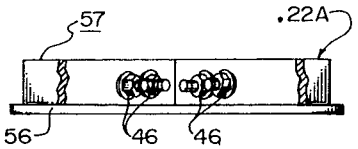
FIG. 12 is an end view of the structure of FIG. 11 and is broken away for convenience of illustration.
Figure 9:
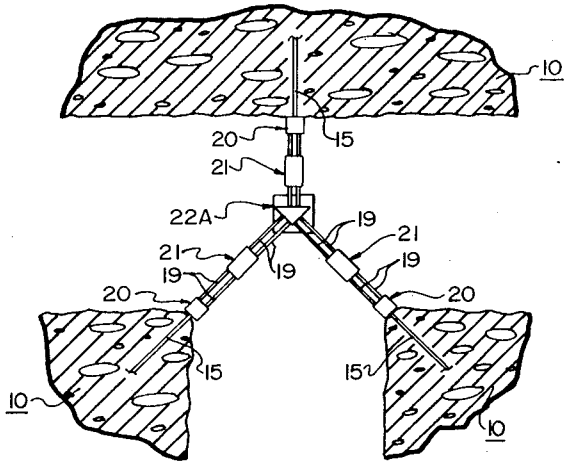
FIGS. 7–10, and 13–16 are top plans, partially sectioned, and in diagramatic form, illustrating various passageway configurations which can be trussed by employing any one of the truss systems herein described.
Figure 10:
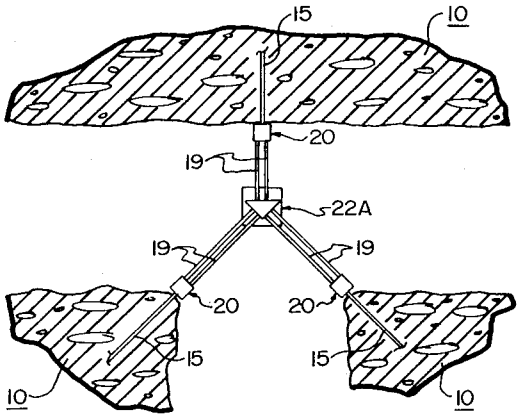
Figure 8:
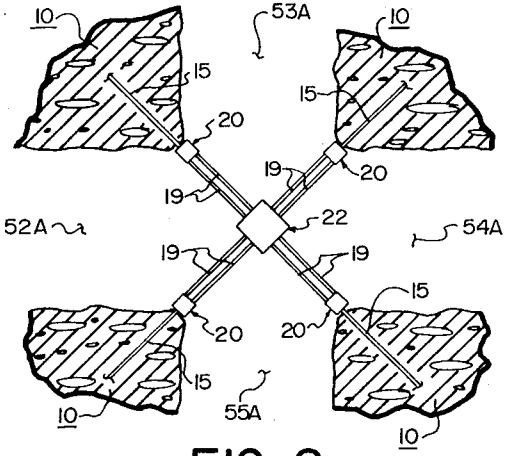

In contrast with FIG. 7, FIG. 8 illustrates that where the width of the corresponding passageways 52A–55A is somewhat reduced, then it is conceivable that the truss brackets 21, namely, the connector brackets of FIG. 2, can be eliminated. In such event the central, plural-way support bracket 22 is employed in connection with tie rods connecting the same to the end brackets 20. FIGS. 9 and 10 illustrate suitable structure of the invention to accommodate three-way passageways in rock structures. Here the plural-way support bracket 22 is modified to the configuration shown at 22A in FIGS. 9–12. Thus, support bracket 22A, corresponding to support bracket 22 in FIG. 7, this time includes bearing plate 56 and, secured thereto and depending therefrom, a depending polygonal flange 57 formed of inter-connected or interjoined flange portions 58, 59, and 60. The flange will preferably be welded to bearing plate 56, and will include at its respective flange portions a series of apertures at 61 to accommodate the several tie rods 19. Tie rods 19 again will be tensioned and secured in place by nuts 46 as threaded onto the individual tie rods. Thus, the structure of FIG. 11 may be secured in place as to the embodiments shown in FIGS. 9 and 10, either with the inclusion of connector brackets 21 as seen in FIG. 9, or with their elimination and the simple connection of tie rods 19 directly from support bracket 22A to end truss brackets 20.

It is conceivable for some passageways-accommodating truss structures that the central plural-way support bracket 22 can be eliminated, this particularly where passageway size is not great. In such event, one or more connector brackets 21 can be employed in combination with the aforementioned tie rods 19, with the tie rods being secured in place and tensioned by the aforementioned securement nuts 46 (not shown). At approximately the midpoint of the passageway structure, one set of tie rods will simply pass over the remaining central set as seen in FIG. 15.

Figure 14:
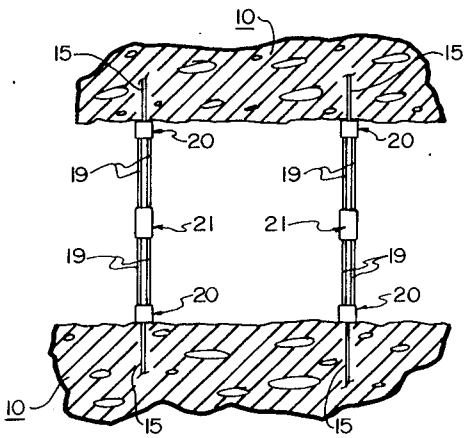
Figure 15:
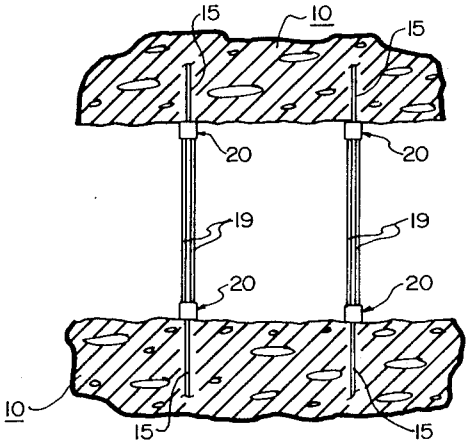

For passageways and/or entries as seen in FIG. 14, the truss structure may take the form of that seen in FIG. 15. Accordingly, the connector brackets 21 are employed to support the central portion of the roof structure, by way of example. The end brackets 20 will be secured in place in the manner shown in FIG. 1. Where passageway width is sufficiently reduced, then it is conceivable that the connector structure be eliminated and the two end brackets 20 simply joined together by a single pair of tie rods 19. This latter structural truss condition is seen in FIG. 15.

Figure 16:
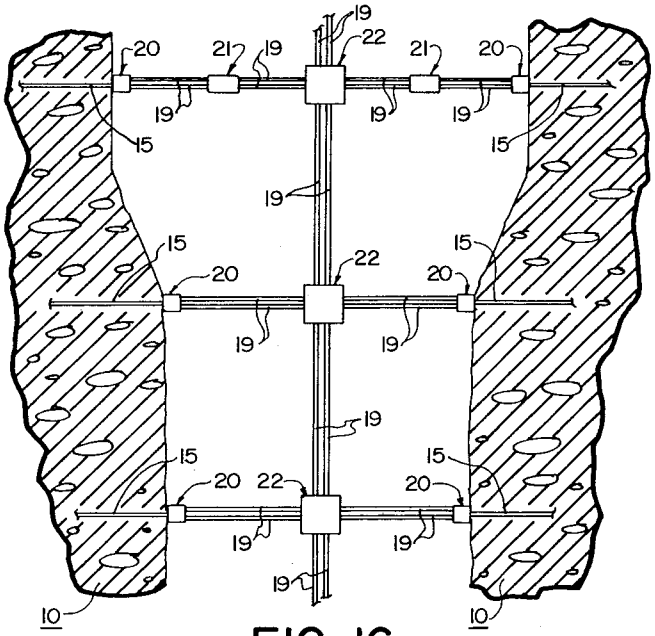
Figure 13:
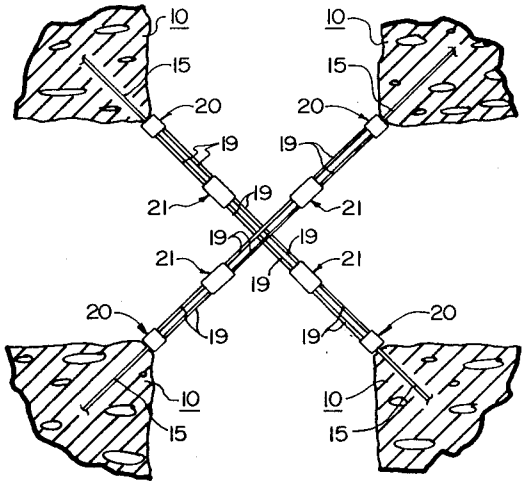

Additionally, to add pre-tensioned rigidity to the structure, the truss brackets are connected together in the several manners indicated, and the tension tie rods tightened down by the cooperating attachment nuts 46. That serves to increase compressive forces in the roof structure of the formation so as to support such roof structure and tend to eliminate roof droppings or cave-ins. Note FIG. 16.

It will be understood that the present invention contemplates usage thereof as floor trusses, roof trusses, intersection trusses, and entry trusses, by way of example.

A final word as to connector bracket 21: it is seen that the opposite ends thereof on either side of the bracket are outwardly-spaced relative to the depending flanges welded to the bearing plate and provide their support thereto with the several welded gussets shown. Also, by the use of gusset pairs in the structures shown, force couples are essentially eliminated.

In assembly, the anchor bolts are first installed in the rock formation; then the truss brackets are loosely installed thereon. Subsequently, the tie rods are loosely installed. Then the anchor bolt nuts are tightened down. And finally, the tie rods are tensioned by turning down their respective nuts.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A rock-formation-supporting truss connector bracket including, in combination: a bearing plate having opposite ends and provided with an anchor-bolt aperture intermediate said ends; a pair of mutually depending flanges integral with and depending from said bearing plate on opposite sides of said aperture, said flanges each having plural, tie rod receiving apertures, said flanges also being inset from opposite ends of said bearing plate; and gusset means disposed between and integral with said flanges and said bearing plate proximate said opposite ends for supporting said flanges against the tensioning of external tie rods to be secured to said flanges at said flange apertures.

2. A rock-formation-supporting, plural-way truss support bracket including, in combination: a bearing plate having an upper bearing surface and an intermediate anchor-bolt receiving aperture passing through said surface; plural flange portions integral with and depending from said bearing plate about and mutually spaced from said aperture, said flange portions each having plural tie rod receiving apertures.

3. The structure of claim 2 wherein said flange portions are joined together.

4. The structure of claim 3 wherein said flange portions in the composite form a polygon.

5. The structure of claim 3 wherein said flange portions mutually form a triangle.

6. The structure of claim 3 wherein said flange portions mutually form a rectangle.

7. A rock-formation supporting truss including, in combination: oppositely facing truss end brackets each having a bearing plate having an anchor bolt passage aperture, a depending flange integral with said bearing plate and having plural tie rod receiving apertures, and a gusset disposed intermediate said flange apertures and between and integral with said flange and said bearing plate, said gusset being provided with an angulated, anchor-bolt-receiving aperture communicating angularly through said bearing plate at said anchor bolt passage aperture; a truss connector bracket having a bearing plate provided with an anchor bolt aperture and depending flanges disposed on opposite sides of said anchor bolt aperture thereof, said flanges each having plural tie rod receiving apertures, said truss connector bracket also including gusset means integral with said bearing plate and said flanges on sides thereof opposite said anchor bolt aperture; first and second sets of threaded tie rods interconnecting said truss connector bracket with said truss end brackets, the ends of said tie rods passing through the flange apertures of said truss connector bracket and said truss end brackets; tie-rod-tensioning securement nuts threaded onto said tie rods at the ends thereof and bearing toward said flanges, respectively; rock-formation threaded anchor bolts passing through said bearing plates of said truss end brackets, at said gusset apertures and bearing plate anchor bolt passage apertures, and said truss connector bracket at said anchor bolt aperture thereof; and plural nut means threaded onto said anchor bolts for retaining said bearing plates against an external rock formation.

8. A multiple-way truss including, in combination: a plural-way truss support bracket comprising a bearing plate having an upper bearing surface and an intermediate anchor-bolt receiving aperture passing through said surface, a plurality of flange portions integral with and depending from said bearing plate about and mutually spaced from said aperture, said flange portions each having plural tie-rod receiving apertures; a series of truss end brackets each having a bearing plate provided with an anchor bolt passage aperture, a depending flange integral with said bearing plate and having plural tie-rod receiving apertures, and a gusset disposed intermediate said flange apertures and between and integral with said flange and said bearing plate thereof, said gusset being provided with an angulated, anchor-bolt-receiving aperture communicating angularly through said bearing plate thereof at said anchor bolt passage aperture; plural tie rod tensioning means interposed between and intercoupling said truss support bracket with said truss end brackets at said flange portion and flange apertures thereof; outwardly extending angulated anchor bolts passing through said truss end brackets at said gussets and having anchor bolt tensioning nut means threaded thereon and bearing toward said gussets; and an anchor bolt passing through said truss support bracket bearing plate at said intermediate anchor-bolt receiving aperture thereof and provided with anchor bolt tensioning nut means threaded thereon and bearing toward said bearing plate thereof.

9. The structure of claim 8 wherein said flange portions of said truss support bracket are joined together and form a polygon.

10. The structure of claim 9 wherein said flange portions form a rectangle.

11. The structure of claim 9 wherein said flange portions form a triangle.

12. Structure according to claim 9 wherein each of said tie rod means comprises: a truss connector bracket having a bearing plate provided with an anchor bolt aperture, and a pair of mutually spaced depending flanges integral with said bearing plate on opposite sides of said aperture and each having tie-rod receiving apertures, a first set of tie rod means tensioningly intercoupling said flanges, at said apertures thereof, of a respective truss end bracket and said truss connector bracket, and a second set of tie road means tensioningly intercoupling said flange and flange portion, at said apertures thereof, of said truss connector bracket and said truss support bracket.

13. The structure of claim 12 wherein said flange portions of said truss support bracket are joined together to form a rectangle.

14. The structure of claim 12 wherein said flange portions of said truss support bracket are joined together to form a triangle.

15. In combination: a series of essentially parallel, mutually spaced truss structures each including a central truss support bracket, truss end brackets respectively disposed on opposite sides of said truss support bracket, plural tie rod means respectively intercoupling said truss end brackets with said truss support bracket, and laterally extending tensionable rock bolt means connected to said truss support bracket and said truss end brackets for securing said brackets forceably against an exterior rock formation surface, whereby to maintain said rock formation above said surface in compression; and plural sets of tie rod means respectively tensioningly intercoupling the truss support brackets of adjacent ones of said truss structures, said rock bolt means being essentially aligned medially with respect to said plural sets of tie rod means.

16. The structure of claim 15 wherein said truss structures each include intermediate truss connector brackets respectively interposed between said truss end brackets, respectively, and said truss support bracket, and plural tie rod means tensioningly intercoupling said truss connector brackets to and between said truss end brackets, respectively, and said truss support bracket, said truss connector brackets each being provided with laterally extending rock bolts.

17. In a rock formation having a bearing surface, in combination: a pair of angulated, oppositely outwardly oriented anchor bolts anchored in said rock formation; a truss structure bearing against said bearing surface and engaging and secured to said anchor bolts in tension such that said anchor bolts are also in tension; a threaded, additional anchor bolt anchored in said rock formation intermediate said pair and engaging said truss structure; and nut means reacting against said truss structure and threadedly secured to said additional anchor bolt, whereby to maintain said additional anchor bolt in tension and the said rock formation as proximately surrounds said additional anchor bolt in increaded compression.

* * * * *

REEXAMINATION CERTIFICATE (1212th)

United States Patent [19]

Seegmiller

[11] B1 4,666,344

[45] Certificate Issued Feb. 27, 1990

[54] TRUSS SYSTEMS AND COMPONENTS THEREOF

[76] Inventor: Ben L. Seegmiller, 3500 Loren Von Dr., Salt Lake City, Utah 84124

Reexamination Request:
No. 90/001,759, Apr. 21, 1989

Reexamination Certificate for:

| | |
|---|---|
| Patent No.: | **4,666,344** |
| Issued: | **May 19, 1987** |
| Appl. No.: | **809,139** |
| Filed: | **Dec. 16, 1985** |

[51] Int. Cl.[4] ..... E21D 20/00; E21D 21/00
[52] U.S. Cl. ..... 405/259; 405/288
[58] Field of Search ..... 405/259

[56] References Cited

U.S. PATENT DOCUMENTS

| | | | |
|---|---|---|---|
| 692,309 | 2/1902 | Knoche . | |
| 3,163,012 | 12/1964 | Dempsey | 405/259 |
| 4,498,816 | 2/1985 | Korpela et al. | 405/259 |
| 4,632,605 | 12/1986 | Tucker | 405/259 |
| 4,679,967 | 7/1987 | Hipkins, Sr. et al. | 405/288 |

OTHER PUBLICATIONS

"Evaluation of Roof Trusses, Phase I", C. P. Mangelsdorf, Feb. 28, 1979.

"Current Trends in Roof Truss Hardware", C. P. Mangelsdorf, presented Jul. 19–21, 1982.

*Primary Examiner*—Dennis L. Taylor

[57] ABSTRACT

Truss systems and components thereof for use in connection with supporting rock formations in underground mines, caverns, storage vaults, and so forth. Multiple types of truss brackets of unique design are incorporated in the various systems which also include tensioning tie rods and anchor bolts. The truss bracket components are designed so that a minimum or no force couples are exhibited when the tie rod means employed are tightened down in their interconnection between associated truss brackets. Various truss systems accommodate mine entries, two-way; three-way, and four-way passageway configurements, and so forth. Additionally, provision is made for intercoupling trusses together.

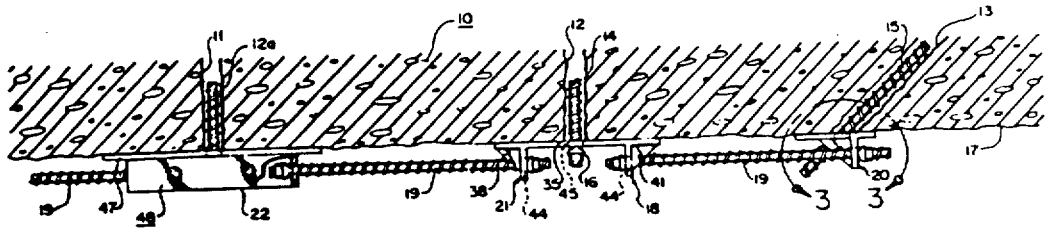

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1 and 7–17 is confirmed.

Claim 2 is determined to be patentable as amended.

Claims 3–5 and 6, dependent on an amended claim, are determined to be patentable.

2. A rock-formation-supporting, plural-way truss support bracket including, in combination: a bearing plate having an upper bearing surface and an intermediate anchor-bolt receiving aperture passing through said surface; plural flange portions integral with and depending from said bearing plate about and mutually spaced from said aperture, said flange portions each having plural tie rod receiving apertures; *and an elongate anchor bolt passing through said anchor bolt receiving aperture and provided with means, for tensioning said anchor bolt, reactively thrusting against said bearing plate and disposed between said plural flange portions.*

* * * * *